US006499381B2

(12) United States Patent
Ladish et al.

(10) Patent No.: US 6,499,381 B2
(45) Date of Patent: Dec. 31, 2002

(54) NOSEPIECE ASSEMBLY FOR A POWER TOOL

(75) Inventors: Curtis J. Ladish, Brookfield, WI (US); Robert W. Klemm, Colgate, WI (US)

(73) Assignee: Milwaukee Electric Tool Corporation, Brookfield, WI (US)

( * ) Notice: Subject to any disclaimer, the term of this patent is extended or adjusted under 35 U.S.C. 154(b) by 0 days.

(21) Appl. No.: 09/925,050

(22) Filed: Aug. 8, 2001

(65) Prior Publication Data

US 2002/0043136 A1 Apr. 18, 2002

Related U.S. Application Data

(60) Provisional application No. 60/224,661, filed on Aug. 11, 2000.

(51) Int. Cl.[7] ..... B25B 23/00
(52) U.S. Cl. ..... 81/429; 81/54
(58) Field of Search ..... 81/429, 54, 52, 81/57.42

(56) References Cited

U.S. PATENT DOCUMENTS

| | | | | | |
|---|---|---|---|---|---|
| 2,940,488 | A | | 6/1960 | Riley, Jr. | |
| 3,454,059 | A | * | 7/1969 | Sindelar | 81/429 |
| 3,527,273 | A | | 9/1970 | Falter | |
| 3,710,832 | A | | 1/1973 | Lafferty, Sr. | |
| 3,712,352 | A | * | 1/1973 | Lafferty, Sr. | 81/429 |
| 4,030,383 | A | | 6/1977 | Wagner | |
| 4,647,260 | A | * | 3/1987 | O'Hara et al. | 81/429 |
| 4,766,783 | A | | 8/1988 | Stanich et al. | |
| 5,012,708 | A | | 5/1991 | Martindell | |
| 5,044,233 | A | * | 9/1991 | Tatsu et al. | 81/429 |
| 5,182,973 | A | | 2/1993 | Martindell | |
| 5,207,127 | A | | 5/1993 | Nick | |
| 5,341,704 | A | * | 8/1994 | Klemm | 81/429 |
| 5,380,132 | A | * | 1/1995 | Parks | 81/429 |
| 5,509,330 | A | | 4/1996 | Nick | |
| 5,524,512 | A | | 6/1996 | Wolfe | |
| 5,538,089 | A | | 7/1996 | Sanford | |
| 5,601,387 | A | * | 2/1997 | Sanford et al. | 81/429 |
| 5,881,613 | A | * | 3/1999 | Han | 81/429 |

* cited by examiner

*Primary Examiner*—James G. Smith
*Assistant Examiner*—Hadi Shakeri
(74) *Attorney, Agent, or Firm*—Michael Best & Friedrich LLP

(57) ABSTRACT

A nosepiece assembly, such as a two-piece locator assembly. The assembly is selectively mountable on a tool housing in coaxial relation with a driven tool attachment. The locator assembly includes a mounting sleeve having a plurality of tabs that can be snapped into a circumferential groove on the tool housing to thereafter releasably restrain axial movement of the sleeve relative to the tool housing. The locator assembly and the tool housing also include cam members that are arranged to provide axial movement to the locator assembly when a rotational force is applied to the mounting sleeve. This arrangement permits the locator assembly to be easily and quickly snapped on and off the tool housing with one hand while allowing an improved attachment means to provide stability to the locator assembly when in a supported position.

37 Claims, 4 Drawing Sheets

NOSEPIECE ASSEMBLY FOR A POWER TOOL

This application claims the benefit of Provisional Application No. 60/224,661, filed Aug. 11, 2000.

FIELD OF THE INVENTION

The invention relates to power tools and, more particularly, to a nosepiece assembly, such as a locator assembly, which is supported on the power tool.

BACKGROUND OF THE INVENTION

U.S. Pat. No. 4,647,260 illustrates a power tool including a nosepiece assembly, such as a locator assembly to control the depth to which screws are driven into a workpiece. In this assembly, a locator is threaded into a collar that can be snapped onto the nose portion of a tool housing. Thereafter, the locator is non-rotatably mounted on the tool housing via cooperating keys and keyways on the tool housing and the locator, respectively. Also, indexing fingers on the collar engage complementary bumps on the tool housing to maintain the collar in a predetermined angular position relative to the housing so as to maintain a desired depth setting.

U.S. Pat. No. 5,341,704 shows another example of a nosepiece assembly, such as a locator assembly. In this assembly, a two-piece locator assembly is selectively mountable on a tool housing in coaxial relation with a driven tool attachment. The locator assembly includes a mounting sleeve having an internal annular flange that can be snapped over a retaining ring on the tool housing to thereafter releasably restrain axial movement of the sleeve relative to the tool housing. A detent arrangement between the tool housing and the sleeve prevents rotation of the sleeve relative to the tool housing after the sleeve has been snapped thereon.

SUMMARY OF THE INVENTION

In some prior art nosepiece assemblies, in connecting the nosepiece assembly to the power tool, the attaching structure provides such a tight engagement between the assembly and the tool housing that removal of the assembly by hand is difficult or impossible. The operator must apply a significant axial force to the assembly to remove it from the tool housing.

In some other prior art devices, the attaching structure provides a loose engagement between the assembly and the tool housing which, while easier to remove, provides less stability of the assembly on the tool housing. This may result in vibration or rattling of the assembly on the power tool and noise during operation of the power tool.

The apparatus and method of the present invention alleviates the problems with the above-described assemblies and prior art devices. The present invention provides a nosepiece assembly including attaching structure, which provides a sufficient attaching force to stabilize the nosepiece assembly on a power tool, and structure for overcoming the attaching force to assist an operator in easily removing the nosepiece assembly from the power tool.

The present invention provides a power tool including an improved nosepiece assembly, such as a locator assembly, which can be easily and quickly removed from and replaced on the power tool with one hand and a simple twist-off or pop-off action without disturbing a previously-set depth setting. The assembly includes snap-fit restricting structure for mounting the assembly on the tool housing and structure for overcoming the axial restricting force to release the locator assembly from the tool. The snap-fit restricting structure and the overcoming structure cooperate to permit the assembly to be snapped onto and popped off of the power tool while preventing the depth setting of the tool bit from being unintentionally or inadvertently changed.

More specifically, the invention provides a two-piece nosepiece or locator assembly that is selectively mountable on a tool housing in coaxial relation with a driven tool attachment. The locator assembly includes a mounting sleeve having a plurality of tabs that can be snapped into a circumferential groove on the tool housing to thereafter releasably restrain axial movement of the sleeve relative to the tool housing. The locator assembly and the tool housing also include cam members that are arranged to provide axial movement to the locator assembly when a rotational force is applied to the mounting sleeve. This arrangement permits the locator assembly to be easily and quickly snapped on and off the tool housing with one hand while allowing an improved attachment means to provide stability to the locator assembly when in a supported position.

Other features and advantages of the invention will become apparent to those skilled in the art upon review of the following detailed description, claims, and drawings.

BRIEF DESCRIPTION OF THE DRAWINGS

FIG. 2 is an enlarged sectional view of the front portion of the power tool illustrated in FIG. 1 and showing the assembly in a supported position on the power tool.

Figure 1:
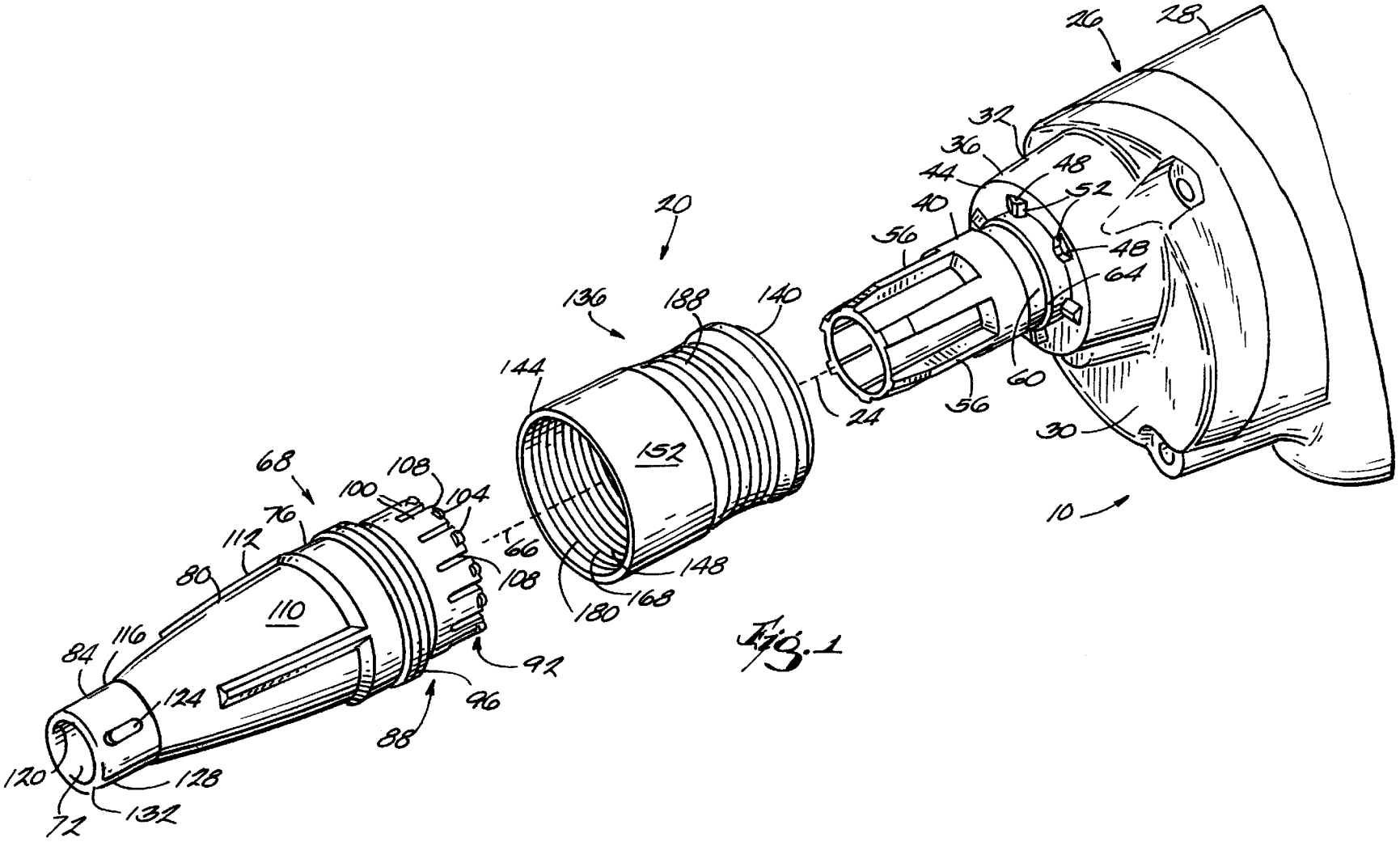
FIG. 1 is an exploded perspective partial view of a power tool including a nosepiece assembly embodying the invention.

Before one embodiment of the invention is explained in detail, it is to be understood that the invention is not limited in its application to the details of construction and the arrangements of the components set forth in the following description or illustrated in the drawings. The invention is capable of other embodiments and of being practiced or being carried out in various ways. Also, it is understood that the phraseology and terminology used herein is for the purpose of description and should not be regarded as limiting. The use of "including" and "comprising" and variations thereof herein is meant to encompass the items listed thereafter and equivalents thereof as well as additional items.

DETAILED DESCRIPTION OF THE PREFERRED EMBODIMENTS

Illustrated in FIG. 1 is a hand-held power tool 10 including a nosepiece assembly 20 embodying the invention. In the illustrated construction, the nosepiece assembly 20 is a depth locator assembly for adjustably setting the depth to which a fastener is driven by the power tool 10. In other constructions (not shown), the nosepiece assembly 20 may be another type of assembly that is removably attached to the nose of a power tool, such as, for example, an extension assembly or a screw feeder assembly.

As shown in FIG. 1, the power tool 10 defines a tool axis 24 and includes a tool housing 26. The tool housing 26 includes a molded rear housing portion 28 and a forward portion 30 having a cast nose portion or gear case 32. It should be understood that the housing 26 and gear case 32 may be fabricated using any suitable method and may be made of any suitable material.

The gear case 32 includes a main section 36 assembled to the housing 26 and a generally cylindrical section 40 coaxial with the tool axis 24 and extending forwardly from the main section 36. The main section 36 of the gear case 32 includes a medial face 44 arranged generally perpendicularly to the tool axis 24. The medial face 44 includes thereon a plurality of azimuthally-spaced-apart and axially-extending cam members 48, each having at least one cam surface 52.

The cylindrical section 40 includes a plurality of axial ribs 56 that taper inwardly toward the tool axis 24 and away from the medial face 44. The cylindrical section 40 also includes a circumferential groove 60 proximate the medial face 44. The circumferential groove 60 has beveled edges 64. In other constructions (not shown), a plurality of circumferentially spaced recesses or pockets may be provided in place of the circumferential groove 60.

The power tool 10 also includes a drive mechanism (not shown) housed by the tool housing 26 for driving a tool attachment including a tool or bit holder (not shown) and a tool bit (not shown) housed in coaxial relation within the cylindrical section 40 of the gear case 32.

As discussed above, in the illustrated construction, the nosepiece assembly is a locator assembly for controlling the axial depth to which a screw or other fastener is advanced or driven into a workpiece (not shown). As shown in FIG. 1, the assembly 20 defines an assembly axis 66 and includes a depth locator member 68. The locator member 68 has a central bore 72 and, when the nosepiece assembly 20 is operably connected to the gear case 32 (see FIGS. 1 and 2), extends axially forwardly from the gear case 32 to house the tool bit. The molded locator member 68 includes a first cylindrical portion 76, a generally frustoconically-shaped shaped portion 80 extending axially forward from the first portion 76, and a second cylindrical portion 84 extending axially forward from the portion 80.

The first portion 76 of the locator member 68 includes a threaded portion 88 and a finger portion 92. The threaded portion 88 includes a circumferentially and radially-outward-extending thread 96. The finger portion 92 includes a plurality of resilient fingers 100 extending axially rearwardly from the threaded portion 88. At least one and, preferably, each finger 100 includes a radially- and outwardly-extending projection 104 at a rearward end 108 of the finger 100. In alternate constructions, only a subset of the fingers 100 include projections 104.

The portion 80 of the locator member 68 includes an outer surface 110 having a plurality of axially-extending ribs 112 to assist an operator in gripping the locator member 68. Operating instructions or graphical diagrams (not shown) may also be formed on the outer surface 110.

The second portion 84 of the locator member 68 includes an outer surface 116, an inner surface 120, and a plurality of apertures 124 therebetween to assist an operator in viewing the interior of the locator member 68 and to facilitate the expelling of debris from the locator member 68. The second portion 84 also includes an outer end 128 including a metal collet 132 to reduce wear on the locator member 68.

Figure 7:
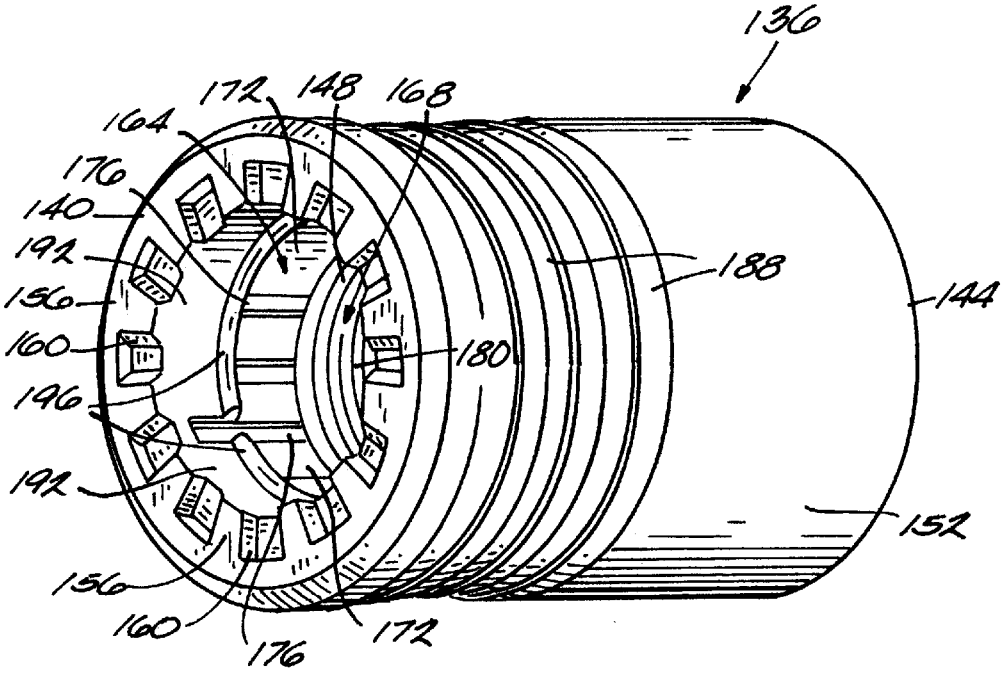
FIG. 7 is a perspective view of a sleeve for the nosepiece assembly illustrated in FIG. 1.

The nosepiece assembly 20 also includes an annular assembly housing or sleeve 136 that is preferably molded as a one-piece unit (see FIG. 7). The sleeve 136 includes a first end face 140, a second end 144, an inner surface 148, and an outer surface 152. The first end face 140 includes thereon a plurality of azimuthally-spaced-apart and axially-extending cam members 156, and each cam member 156 has at least one cam surface 160.

The inner surface 148 includes a ribbed portion 164 and a threaded portion 168. The ribbed portion 164 includes a plurality of azimuthally-spaced-apart and axially-extending ribs 172. The ribs 172 form therebetween a plurality of axially-extending grooves 176. The threaded portion 168 includes a circumferentially and radially-inwardly-extending thread 180 adapted to cooperate with the thread 96 of the locator member 68. The outer surface 152 of the sleeve 136 includes a plurality of circumferential ridges 188 generally adjacent the first end face 140 to assist an operator in gripping the sleeve 136.

The sleeve 136 also includes a plurality of resilient tabs 192 extending generally axially outward from the inner diameter edge of the first end face 140. Each tab 192 includes a radially-inward-projecting projection 196 formed on an axially outward or distal end of the tab 192. In the preferred embodiment, the tabs 192 are angled inwardly toward the tool axis 24. In other constructions (not shown), the plurality of resilient tabs 192 may be replaced by a single resilient ring including radially-inward-projecting projections (similar to the projections 196) or one continuous projection.

Figure 3:
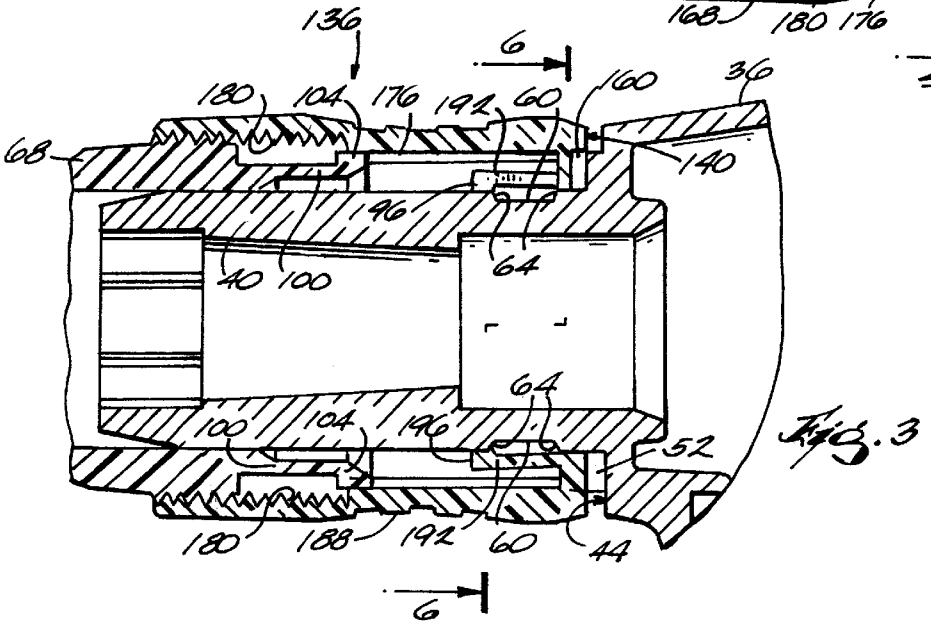
FIG. 3 is a view similar to FIG. 2 and showing the assembly in an unsupported position on the power tool.
Figure 4:
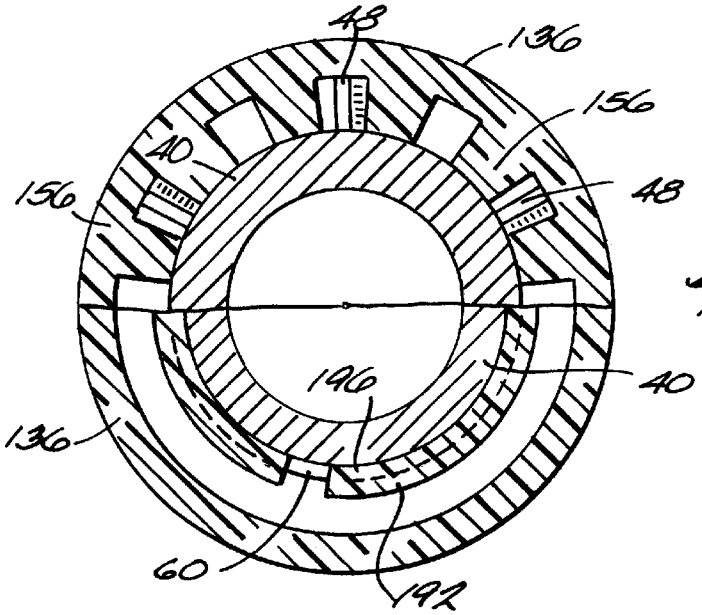

The sleeve 136 and the locator member 68 interconnect so that the axial position of the locator member 68 can be adjusted forwardly and rearwardly relative to the housing 26 to provide operative and secure depth adjustment. While various interconnection means can be employed, in the illustrated arrangement, the interconnection means includes the inter-engaging threads 96 and 180 of the locator member 68 and the sleeve 136, respectively. The locator member 68 is thus threaded into the sleeve 136 such that the axial position of the locator member 68 can be varied by rotating the locator member 68 relative to the sleeve 136 (see FIGS. 2 and 3).

To prevent undesired axial displacement of the locator member 68 relative to the housing 26, the interconnecting means also includes indexing means for maintaining the locator member 68 in a predetermined azimuthal position relative to the sleeve 136. In the illustrated arrangement, the indexing means is independent of the housing 26 and is provided between the locator member 68 and the sleeve 136.

Figure 5:
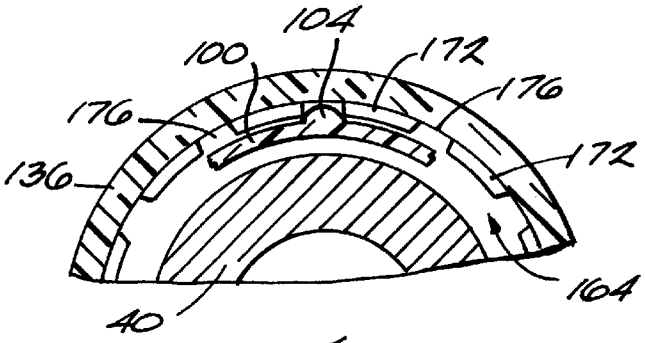
FIG. 5 is a sectional view taken along line 5—5 in FIG. 2.

The indexing means includes the fingers 100, integrally formed with the locator member 68 and projecting rearwardly, in cantilevered relation, from the first cylindrical portion 76 thereof The indexing means also includes the plurality of ribs 172 and the plurality of grooves 176 on the inner surface 148 of the sleeve 136. The projections 104 on the fingers 100 extend radially outward into the complementary grooves 176 to retain the locator member 68 in a desired azimuthal position relative to the sleeve 136 (see FIG. 5). When the locator member 68 is rotated by an operator to change the depth setting, the projections 104 and thus the fingers 100 are displaced radially inward via engagement with the ribs 172 to provide a ratcheting action. When the locator member 68 has been rotated to the next index position, to bring the projections 104 back into registry with the grooves 176, the fingers 100 return to their normal positions and snap the projections 104 back into the grooves 176.

To reduce the resistance to rotational movement between the locator member 68 and the sleeve 136 presented by the projections 104, each of the projections 104 has an arcuate outer surface. This permits the projections 104 to smoothly ramp up onto the ribs 172 as the locator member 68 is rotated relative to the sleeve 136. The arcuate outer surfaces also permit the projections 104 to gradually snap back into the grooves 176 to provide smooth, yet tactilely- and audibly-detectable ratcheting or indexing.

A nosepiece assembly support structure includes structure to releasably attach the nosepiece assembly 20 to the gear case 32. In particular, the attaching structure restricts axial movement of the nosepiece assembly 20 when the nosepiece assembly 20 is mounted in a supported position on the power tool 10, and also permits an operator to remove the nosepiece assembly 20 from the gear case 32 without varying the relative axial position of the locator member 68 with respect to the sleeve 136 when the nosepiece assembly 20 is subsequently repositioned on the gear case 32.

While various structure to releasably attach the nosepiece assembly 20 to the gear case 32 can be employed, in the illustrated construction, the attaching structure provides a releasable snap-fit engagement between the sleeve 136 and the gear case 32. The attaching structure includes the tabs 192 on the sleeve 136 and the circumferential groove 60 on the gear case 32. In other constructions (not shown), a groove may be provided on the sleeve 136, and groove-engaging structure, such as tabs, may be supported on the gear case 32.

To mount the locator assembly 20 onto the gear case 32, the sleeve 136 is placed around the cylindrical section 40 of the gear case 32 and pressed axially rearward against the gear case 32. The tapered ribs 56 on the cylindrical section 40 force the tab projections 196 and thus the tabs 192 radially outward against the biasing force of the tabs 192 created by the resilience and inwardly-angled orientation of the tabs 192.

The operator continues to press rearwardly on the sleeve 136 until the first end face 140 of the sleeve 136 abuts the medial face 44 of the gear case 32. At this point, the tab projections 196 align with the circumferential groove 60 and the tab biasing force causes the tab projections 196 to engage and move into the circumferential groove 60 with an audible and tactile snap (see FIGS. 2 and 4). The sleeve 136 is restricted from axial movement by the biasing force of the tabs 192 projecting the tab projections 196 into the circumferential groove 60.

In addition, because the indexing means is contained entirely within the locator assembly 20 independently of the snap-action attachment between the sleeve 136 and the gear case 32, the depth setting of the locator assembly 20 is not disturbed when the locator assembly 20 is snapped on or off the gear case 32.

Thereafter, the first end face 140 of the sleeve 136 is held against the medial face 44 of the gear case 32. The angle of the face of the tab projections 196 and the beveled edges 64 of the circumferential groove 60 causes faces 140 and 44 to be tightly engaged. In the supported position, the tabs 192 are not in a completely relaxed state, because of the angled engagement of the faces of the tab projections 194 and the beveled edges 64 of the groove 60, causing the sleeve 136 to be biased against the gear case 32. This biasing provides greater stability to the nosepiece assembly 20 on the gear case 32 and eliminates rattling during operation of the power tool 10.

The nosepiece assembly support means also includes structure to restrict rotation of the sleeve 136 relative to the gear case 32 when the nosepiece assembly is mounted in the supported position on the power tool 10. The rotational restricting structure also assists the operator in overcoming the attaching force applied by the attaching structure (the tabs 192 in the groove 60).

In the illustrated construction, the rotational restricting structure and the overcoming structure are provided by the inter-engaging cam members 48 on the gear case 32 and the cam members 156 on the sleeve 136. The cam members 156 of the sleeve 136 are configured to generally alternate with the cam members 48 of the gear case 32. The number of sleeve cam members 156 and gear case cam members 48 do not need to be equal as long as the sleeve cam members 156 and the gear case cam members 48 are azimuthally positioned such that a sleeve cam member 156 does not axially abut a gear case cam member 48 when the nosepiece assembly 20 is mounted in the supported position on the power tool 10.

Figure 4:
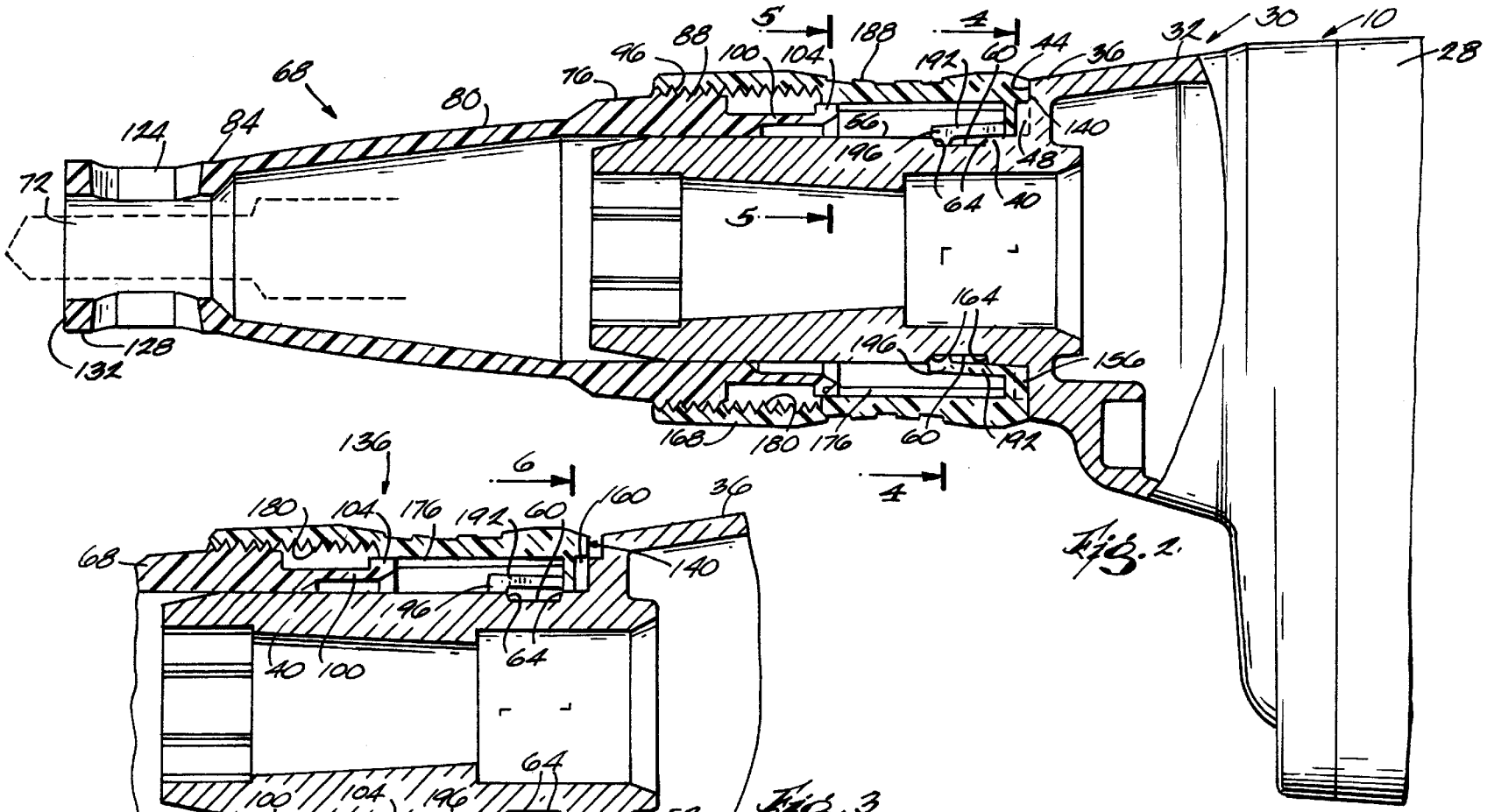
FIG. 4 is a sectional view taken along line 4—4 in FIG. 2.

When mounting the nosepiece assembly 20 on the power tool 10, an operator aligns the sleeve 136 such that the gear case cam members 48 fit between the sleeve cam members 156 and the sleeve cam members 156 fit between the gear case cam members 48 (see FIG. 4). Thus, when the nosepiece assembly 20 is mounted in the supported position on the power tool 10, the sleeve cam members 156 generally alternate with the gear case cam members 48, and the sleeve 136 is prevented from rotation relative to the gear case 32 by the cooperating cam members 48 and 156.

The cam members 48 and 156 also assists the operator in overcoming the attaching or axial restricting force of the tabs 192 and the groove 60 when the operator removes the locator assembly 20 from the power tool 10. Upon rotation of the sleeve 136 relative to the gear case 32, the sleeve cam members 156 and the gear case cam members 48 cooperate through the sleeve cam member cam surfaces 160 and the gear case cam member cam surfaces 52 to force the nosepiece assembly 20 axially forwardly off of the gear case 32.

Figure 6:
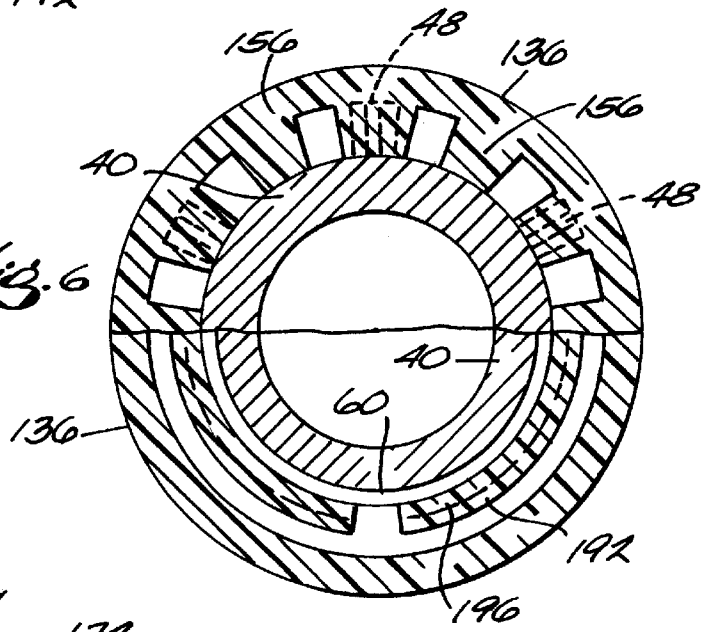
FIG. 6 is a sectional view taken along line 6—6 in FIG. 3.

For example, a complementary pair of a sleeve cam member 156 and a gear case cam member 48 are generally radially-displaced and axially-even when the locator assembly 20 is mounted in the supported position. As the sleeve 136 is rotated by the operator, the cam surface 160 of the sleeve cam member 156 meets and frictionally engages the cam surface 52 of the gear case cam member 48. The angled profiles of the two cam surfaces 52 and 160 causes the cam surface 160 of the sleeve cam member 156 to slide along the cam surface 52 of the gear case cam member 48, thus axially displacing the cam members 48 and 156 relative to each other and also axially displacing the nosepiece assembly 20 from the gear case 32 as the cam members 48 and 156 become radially aligned (see FIG. 6).

The axial displacement of the nosepiece assembly 20 also causes the tab projections 196 to slide up the beveled edge 64 of the circumferential groove 60. The projections 196 are thus released from the circumferential groove 60, and the nosepiece assembly 20 is released from the supported position and moves to the unsupported position.

In operation, the nosepiece assembly 20 can be easily snapped on the gear case 32 via simple axial motion with minimal rotational motion as described above. The nosepiece assembly 20 can also be easily twisted or popped off the gear case 32 via simple axial and rotational motion, as described above, to facilitate, for example, replacement of a tool bit, non-depth controlled work, or removal of a fastener. The assistance of the overcoming structure of the cooperating cam members 48 and 156 allows a relatively greater biasing force to be used in the attaching structure to better maintain the nosepiece assembly 20 in the supported position while still allowing the nosepiece assembly 20 to be easily removed by an operator.

After the nosepiece assembly 20 is snapped onto the gear case 32, incremental rotation of the locator member 68 relative to the sleeve 136 produces an incremental axial displacement of the locator member 68 relative to the housing 28. The tactile and audible clicks produced by interaction of the fingers 100 and the grooves 176 provide an indexing or ratcheting mechanism by which a desired depth setting can be easily and quickly set with a high degree of accuracy. Because the nosepiece assembly 20 operates independently of the remainder of the power tool 10, the nosepiece assembly 20 can be used interchangeably, as a unit, on a variety of tools. Also, if desired, locator assemblies having various depth ranges can be used interchangeably on the same tool to accomplish virtually any desired depth range regardless of the tool attachment employed.

While the nosepiece assembly 20 has been described as part of a power tool 10 employing a tool bit, it should be understood that the nosepiece assembly 20 is useful with a variety of tool attachments including nut-runners, drill bits, etc., and with a variety of power or manually operated tools in which an assembly is attached to the tool.

Advantageously, the invention provides a nosepiece assembly 20 which can be easily snapped onto and twisted or popped off a power tool and which functions as a self-contained unit incorporating an independently operable indexing mechanism for preventing the nosepiece assembly 20 or locator assembly from slipping out of a preselected depth setting until an operator changes the setting. Unlike previous arrangements, the present structure permits an operator to perform servicing, such as tool bit replacement, without disturbing a previously selected depth setting.

A further advantage is achieved by the attaching structure and the overcoming structure. Because the overcoming structure of the cam members 48 and 156 assists the removal of the locator assembly 20 from the gear case 32, a greater biasing force can be employed by the attachment means to provide additional stability to the nosepiece assembly 20 when the nosepiece assembly 20 is in the supported position.

Various features of the invention are set forth in the following claims.

We claim:

1. A nosepiece assembly for use with a power tool, the power tool including a tool housing having a forward portion and defining a tool axis, said nosepiece assembly comprising:

an assembly housing defining an assembly axis and being supportable on the tool housing in a supported position, in which said assembly axis is substantially parallel with the tool axis;

structure to restrict movement of said assembly housing relative to the tool housing along the tool axis from the supported position to an unsupported position, said restricting structure applying a force to restrict axial movement of said assembly housing; and structure to overcome the restricting force and to move said assembly housing to the unsupported position from the supported position;

wherein said overcoming structure includes a cam member supported on the assembly housing engageable to overcome the restricting force.

2. The nosepiece assembly of claim 1, further comprising a locator member connected to the assembly housing, the locator member being positioned relative to the tool housing to set a depth to which a fastener is driven by the power tool.

3. The nosepiece assembly of claim 1, wherein the restricting structure includes a resilient tab engageable with a portion of the tool housing when the housing assembly is in the supported position to apply the restricting force.

4. The nosepiece assembly of claim 3, wherein the tab has a relaxed position, in which the tab does not apply a force, and a biasing position, in which the tab applies a force to move to the relaxed position, and wherein, in the supported position, the tab is in the biasing position engaging the tool housing.

5. The nosepiece assembly of claim 3, wherein the tab extends generally axially from an inner edge of the assembly housing.

6. The nosepiece assembly of claim 3, wherein the tab includes a projection formed on a distal end of the tab and operable to interact with a recess in the tool housing when the housing assembly is in the supported position to apply the restricting force.

7. The nosepiece assembly of claim 6, wherein the tab is angled inwardly at the distal end toward the assembly axis.

8. The nosepiece assembly of claim 1, wherein the overcoming structure includes a plurality of cam members engageable to overcome the restricting force.

9. A nosepiece assembly for use with a power tool, the power tool including a tool housing having a forward portion defining an axis, said nosepiece assembly comprising:

an assembly housing supportable on the tool housing in a supported position;

structure to restrict movement of said assembly housing relative to the tool housing from the supported position to an unsupported position, said restricting structure applying a force to restrict movement of said assembly housing; and a cam member supported on the assembly housing engageable to overcome the restricting force and to move said assembly housing to the unsupported position from the supported position.

10. The nosepiece assembly of claim 9, wherein the restricting structure includes a resilient tab engageable with a portion of the tool housing when the housing assembly is in the supported position to apply the restricting force.

11. The nosepiece assembly of claim 10, wherein the tab has a relaxed position, in which the tab does not apply a force, and a biasing position, in which the tab applies a force to move to the relaxed position, and wherein, in the supported position, the tab is in the biasing position engaging the tool housing.

12. The nosepiece assembly of claim 10, wherein the tab extends generally axially from an inner edge of the assembly housing.

13. The nosepiece assembly of claim 10, wherein the tab includes a projection formed on a distal end of the tab operable to interact with a recess in the tool housing when the housing assembly is in the supported position to apply a restricting force.

14. The nosepiece assembly of claim 3, wherein the tab is angled inwardly at the distal end toward the assembly axis.

15. The nosepiece assembly of claim 9, further comprising a plurality of cam members supported on the assembly housing engageable to overcome the restricting force and to move said assembly housing to the unsupported position from the supported position.

16. The nosepiece assembly of claim 9, further comprising a locator member connected to the assembly housing, the locator member being positioned relative to the tool housing to set a depth to which a fastener is driven by the power tool.

17. A power tool comprising:

a tool housing having a forward portion and defining an axis;

an assembly housing supportable on the tool housing in a supported position;

structure to restrict movement of said assembly housing relative to the tool housing along the axis from the supported position to an unsupported position, the restricting structure applying a force to restrict movement of the assembly housing; and structure to overcome the restricting force and to move the assembly housing to the unsupported position from the supported position;

wherein the overcoming structure includes a first cam member supported on one of the tool housing and the assembly housing and engageable to overcome the restricting force.

18. The power tool of claim 17, further comprising a locator member connected to the assembly housing, the locator member being positioned relative to the tool housing to set a depth to which a fastener is driven by the power tool.

19. The power tool of claim 17, wherein the restricting structure includes a resilient tab on one of the tool housing and the assembly housing and an indentation on the other of the tool housing and the assembly housing, the tab being engageable in the indentation to apply the restricting force.

20. The power tool of claim 19, wherein the tab has a relaxed position, in which the tab does not apply a force, and a biasing position, in which the tab applies a force to move to the relaxed position, and wherein, in the supported position, the tab is in the biasing position engaging the indentation.

21. The power tool of claim 19, wherein the resilient tab is attached to the assembly housing and the indentation is defined by the tool housing.

22. The power tool of claim 19, wherein the resilient tab extends generally axially from an inner edge of the assembly housing.

23. The power tool of claim 19, wherein the tab includes a projection formed on a distal end of the tab operable to interact with a recess in the tool housing when the housing assembly is in the supported position to apply a restricting force.

24. The power tool of claim 23, wherein the tab is angled inwardly at the distal end toward the assembly axis.

25. The power tool of claim 17, wherein the overcoming structure further includes a second cam member on the other of the tool housing and the assembly housing, wherein the second cam member includes a cam surface adapted to cooperate with the first cam member to overcome the restricting force.

26. A power tool comprising:

a tool housing having a forward portion and defining an axis;

an assembly housing supportable on the tool housing in a supported position;

structure to restrict movement of said assembly housing relative to the tool housing along the axis from the supported position to an unsupported position, the restricting structure applying a force to restrict movement of the assembly housing; and structure to overcome the restricting force and to move the assembly housing to the unsupported position from the supported position;

wherein the overcoming structure includes a plurality of cam members supported on one of the tool housing and the assembly housing and engageable to overcome the restricting force.

27. A power tool comprising:

a tool housing defining a housing axis;

an assembly housing defining an assembly axis and supportable on the tool housing in a supported position, in which the assembly axis is parallel with the housing axis;

structure to restrict axial movement of the assembly housing relative to the tool housing from the supported position to an unsupported position, the restricting structure applying a force to restrict axial movement of the assembly housing; and a first cam member supported on one of the tool housing and the assembly housing and engageable to overcome the restricting force and to axially move the assembly housing to the unsupported position from the supported position.

28. The power tool of claim 27, wherein the restricting structure includes a resilient tab supported on one of the tool housing and the assembly housing and engageable with a portion of the other of the tool housing and the assembly housing when the housing assembly is in the supported position to apply the restricting force.

29. The power tool of claim 28, wherein the tab has a relaxed position, in which the tab does not apply a force, and a biasing position, in which the tab applies a force to move to the relaxed position, and wherein, in the supported position, the tab is in the biasing position engaging the other of the tool housing and the assembly housing.

30. The power tool of claim 28, wherein the tab extends generally axially from an inner edge of the assembly housing.

31. The power tool of claim 28, wherein the tab includes a projection formed on a distal end of the tab operable to interact with a recess in the tool housing when the housing assembly is in the supported position to apply a restricting force.

32. The power tool of claim 31, wherein the tab is angled inwardly at the distal end toward the assembly axis.

33. The power tool of claim 27, further comprising a second cam member on the other of the tool housing and the assembly housing, wherein the second cam member includes a cam surface adapted to cooperate with the first cam member.

34. The power tool of claim 27, further comprising a plurality of first cam members supported on one of the tool housing and the assembly housing and engageable to overcome the restricting force and to axially move the assembly housing to the unsupported position from the supported position.

35. The power tool of claim 27, further comprising a locator member connected to the assembly housing.

36. The power tool of claim 27, further comprising a plurality of first cam members supported on the tool housing and a plurality of second cam members supported on the assembly housing, the plurality of first cam members being engageable with the plurality of second cam members to overcome the restricting force and to axially move the assembly housing to the unsupported position from the supported position.

37. A method of removing a nosepiece assembly from a power tool, the method comprising the acts of:

providing a power tool including a tool housing defining an axis and supporting a first cam member and a nosepiece assembly including an assembly housing supporting a second cam member;

rotating the nosepiece assembly relative to the tool housing so that the first cam member engages the second cam member to create an axial spacing between the nosepiece assembly and the power tool housing; and moving the nosepiece assembly axially away from the tool housing.

* * * * *